United States Patent [19]

Dominico

[11] Patent Number: 4,587,926

[45] Date of Patent: May 13, 1986

[54] BOTTOM RIM COATER FOR INTERMITTENTLY OPERATED CONTAINER DECORATING APPARATUS

[75] Inventor: James Dominico, West Paterson, N.J.

[73] Assignee: Van Dam Machine Corporation, West Paterson, N.J.

[21] Appl. No.: 657,547

[22] Filed: Oct. 4, 1984

[51] Int. Cl.[4] ..... B05C 1/02

[52] U.S. Cl. ..... 118/211; 118/219; 118/225; 118/230

[58] Field of Search ..... 118/46, 217, 218, 219, 118/211, 225, 230

[56] References Cited

U.S. PATENT DOCUMENTS

| | | | |
|---|---|---|---|
| 1,461,761 | 7/1923 | Paull et al. | 118/46 |
| 4,077,355 | 3/1978 | Miller | 118/219 |
| 4,337,719 | 7/1982 | vander Griendt et al. | 118/46 |

FOREIGN PATENT DOCUMENTS

| | | | |
|---|---|---|---|
| 223687 | 10/1924 | United Kingdom | 118/219 |

*Primary Examiner*—John P. McIntosh

*Attorney, Agent, or Firm*—David A. Jackson; Daniel H. Bobis

[57] ABSTRACT

An intermittently operated apparatus for decorating cylindrical cans, each can having a cylindrical surface and a rim, includes a rotatable mandrel wheel; a plurality of mandrel assemblies mounted on the mandrel wheel which hold the cans on the mandrel wheel; a surface applicator roll having a length which extends past the bottom of each can and which applies a coating of varnish to the cylindrical surface of each can; a supply assembly for supplying the varnish to the surface applicator roll; a freely rotatable rim applicator roller having a tapered surface positioned in contact with the bottom rim of each can and with that portion of the surface of the surface applicator roll that extends past the bottom of each can, such that the rim applicator roller is driven by the surface applicator roll and varnish is transferred from the surface applicator roll to the tapered surface of the rim applicator roller and then to the bottom rim of each can at the same time that varnish is applied by the surface applicator roll to the cylindrical surface of each can; and a support and adjusting assembly for supporting and positioning the rim applicator roller with respect to the bottom rim of each can and the surface of the surface applicator roll so as to adjust the pressure of the rim applicator roller on the surface applicator roll and to adjust the pressure of the rim applicator roller on the bottom rim of each can.

12 Claims, 4 Drawing Figures

BOTTOM RIM COATER FOR INTERMITTENTLY OPERATED CONTAINER DECORATING APPARATUS

BACKGROUND OF THE INVENTION

This invention relates generally to a machine for applying a finish to the exterior surfaces of containers, such as cylindrical cans and, in particular, is directed to a portion of such machine for applying a finish to the bottom rim of a cylindrical can.

In general, a variety of machines for applying decorative finishes to containers such as cans and the like are known and comprise an infeed or conveyor assembly that transports the cans to a positioning unit that receives the cans and moves them into position for transfer to corresponding mandrels located on an axially adjacent rotatable mandrel wheel. After the cans are received on the corresponding mandrels, the mandrels are rotated into position for the printing operation, where a printing blanket is brought into contact with each of the containers, to place a decoration on the outer cylindrical surface thereof. Thereafter, the mandrels bearing the containers are moved to another location where a coat of varnish is applied to the decorated outer surface of each can to finish the decoration thereon. With conventional high speed continuously operating machines, the varnish is cured in an oven, while with slower intermittently operated machines, the varnish is cured by ultraviolet light at a subsequent station or by an oven.

Varnish is also desirably applied to coat the bottom rim of each can in order to protect the bottom rim from aluminum oxide deposited thereon during subsequent travel through the system. In the instance of continuously operating machines, the cans are removed from the aforementioned printing and varnishing stations by a pin chain and may be inclined thereon at an angle of approximately 10 degrees with respect to the mandrel assemblies. Varnish is applied to the bottom rim with a flat roller, and thereafter, the container with the varnished bottom rim and varnished cylindrical surface is transported to an oven where the varnish is cured.

With conventional intermittently operating machines which coat the bottom rims of the cans, the varnish on the bottom rim is applied and dried in the same manner as the aforementioned continuously operating machines.

It is to appreciated that the oven in the continuously operating machines is necessary to cure the varnish on the cylindrical surfaces which is not dried or cured when exiting on the pin chain. By contrast, intermittently operating machines which utilize ultraviolet light to dry the varnish on the cylindrical surfaces before the cans leave on the pin chain do not require an oven. The application of varnish to the bottom rims of the cans while on the pin chain in such an intermittently operating machine would therefore require the addition of an oven to cure or dry such varnish, which oven is otherwise not required.

OBJECTS AND SUMMARY OF THE INVENTION

Accordingly, it is an object of this invention to provide an intermittently operated container decorating apparatus which applies varnish to the bottom rim of each container at the same time that varnish is applied to the cylindrical surface thereof.

It is another object of this invention to provide an intermittently operated container decorating apparatus that applies varnish to the bottom rim of each container without the necessity of utilizing an oven for curing the same.

It is still another object of this invention to provide an intermittently operated container decorating apparatus in which the roller for applying varnish to the cylindrical surface of each container drives and supplies varnish to a roller which applies varnish to the bottom rim of each container.

In accordance with an aspect of the present invention, an intermittently operated apparatus for decorating cylindrical containers, each container having a cylindrical surface and a rim, includes rotatable mandrel wheel means; a plurality of mandrel assembly means mounted on the mandrel wheel means for holding the containers on the mandrel wheel means; surface applicator roll means for applying a coating of material to the cylindrical surface of each container; supply means for supplying the material to the surface applicator roll means; and rim applicator roll means cooperating with the surface applicator roll means for applying a coating of the material on the rim of each container.

More particularly, the rim applicator roll means is driven by and supplied with varnish by the surface applicator roll means. The pressure of the rim applicator roll means on the surface applicator roll means can be adjusted to vary the amount of varnish transferred to the rim applicator roll means. In like manner, the pressure of the rim applicator roll means on the bottom rim of each container can be adjusted.

The above, and other, objects, features and advantages of the present invention will become readily apparent from the following detailed description thereof which is to be read in connection with the accompanying drawings.

DETAILED DESCRIPTION OF A PREFERRED EMBODIMENT

Figure 1A:
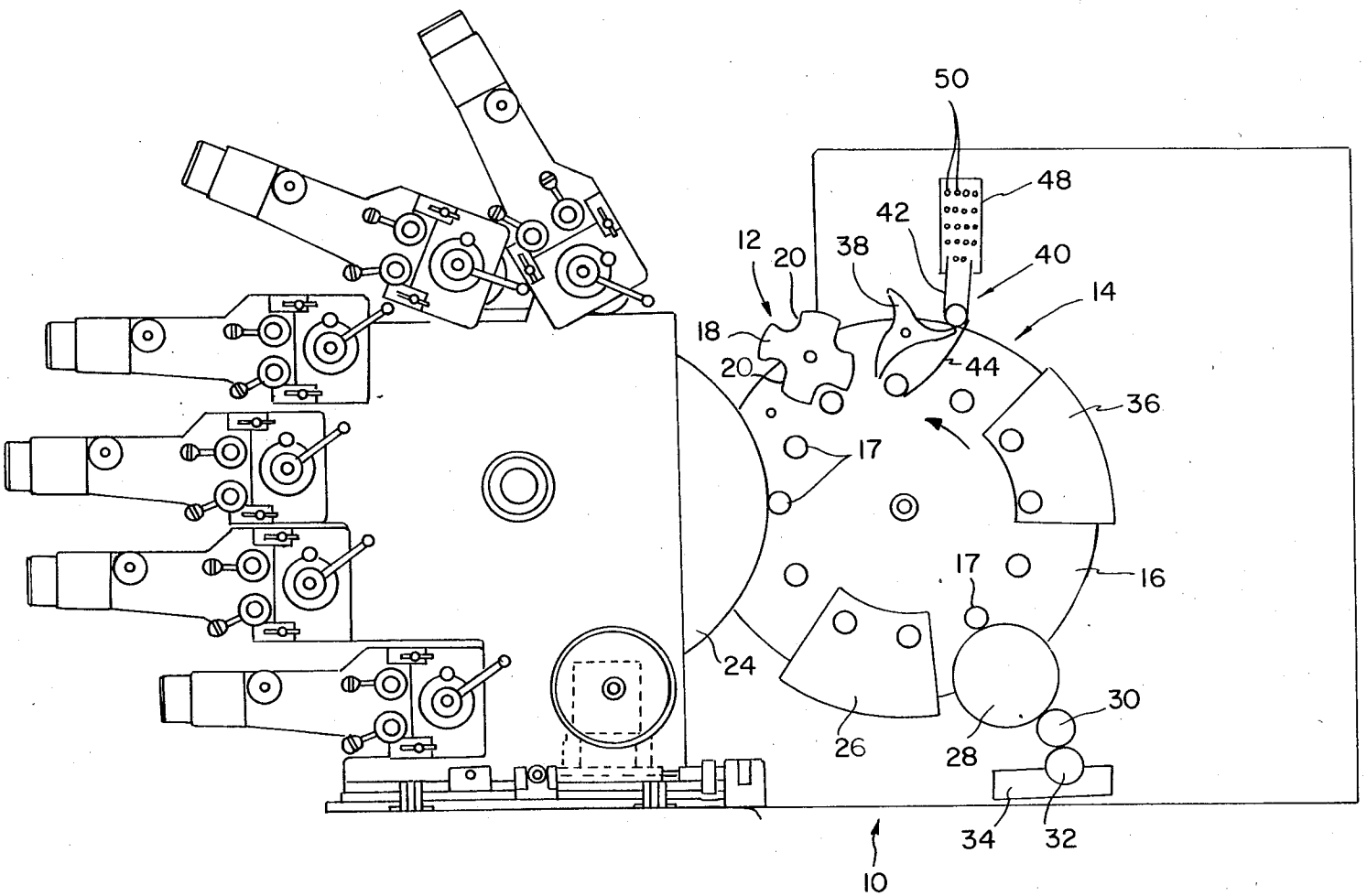
FIG. 1A is a schematic, front elevational view of an intermittently operating container decorating apparatus of the type with which the present invention can be used.

Referring to the drawings in detail, and initially to FIG. 1A thereof, an intermittently operated container decorating apparatus 10 with which the present invention can be used includes an infeed system 12 that initially transports the incoming containers to a mandrel wheel assembly 14 which is adapted to cooperate therewith to pick up the incoming containers. Mandrel wheel assembly 14 comprises an intermittently rotatable mandrel wheel 16, and a plurality of regularly spaced stationary mandrel assemblies 17 are rotatably mounted along the circumferential periphery thereof.

The mandrel assemblies 17 are essentially cylindrical and extend transversely away from mandrel wheel 16. Each mandrel assembly 17 includes a container receiving mandrel at the free end thereof and the mandrel assemblies are continuously rotated about their central axes by a belt driven arrangement (not shown), but fixed at positions on mandrel wheel 16.

Infeed system 12 includes a pocket wheel 18 shown in FIG. 1A having four equidistant, spaced pockets 20 which are supplied with containers 22 from an input conveyer (not shown). Pocket wheel 18 is intermittently rotated to position a container 22 directly over a mandrel assembly 17. At such time, a pusher bar (not shown) pushes the respective container 22 partially toward the respective mandrel assembly 17 which utilizes vacuum suction means (not shown), as is conventional in the art, to pull the container 22 thereon for intermittent travel with mandrel wheel 16.

With this arrangement, mandrel assemblies 17 and mandrel wheel 16 are rotated intermittently by suitable drive means (not shown), so that mandrel assemblies 17 intermittently withdraw cylindrical containers 22 from infeed system 12 by vacuum suction means.

Once disposed upon the mandrel, containers 22 are moved stepwise or intermittently into surface contact with a rotating image-transfer roller designated schematically at 24, that forms a part of the printing station of apparatus 10. Thereafter, containers 22, remaining on the mandrels, are rotated away from the printing station and the printing ink is dried at a subsequent ultraviolet light drying station 26.

The containers are then rotated and are given a coating of varnish, by means of peripheral surface engagement with a varnish applicator roll 28 that forms a part of the varnishing station of assembly 10. Varnish applicator roll 28 is generally made of a rubber or like material and is rotated by suitable transmission means, not shown. Varnish is applied to varnish applicator roll 28 by steel rolls 30 and 32 which, in turn, are supplied with varnish from a reservoir 34, as is well known in the art. In accordance with the present invention, varnish is also applied to the bottom rim of each container 22 at this position, as will be described in greater detail hereinafter.

After the printing and varnishing operation has been completed, containers 22 are intermittently rotated away from the varnishing station, and rotated to a drying or curing station 36, shown schematically in FIG. 1A, at which the varnish is dried by ultraviolet light. Since the rotational movement is intermittent, the ultraviolet light is sufficient to dry the varnish.

Figure 1B:
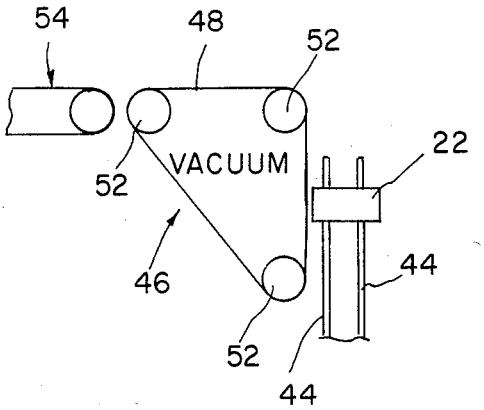
FIG. 1B is a schematic view of a portion of the assembly for removing the cans from the mandrel wheel.

Thereafter, the containers 22 are intermittently transferred by means of a three-point star wheel 38 to an output guide assembly 40 comprised of upper guide bars 42 and lower guide bars 44. Only lower guide bars 44 are shown in FIG. 1B for the sake of simplicity and clarity. From guide asembly 40, each container 22 is transferred to a vacuum belt 46, that is, a belt 48 having apertures 50 through which a vacuum is applied to hold the bottom of each container 22. As shown in FIG. 1B, belt 48 forms an endless loop in a triangular configuration about guide rollers 52. However, belt 48 may be configured in any manner consistent with the present invention. From vacuum belt 46, each container is transferred to an output conveyer belt 54, and for example, at the intersection of belts 46 and 54, the vacuum is broken to effect such transfer.

Figure 2:
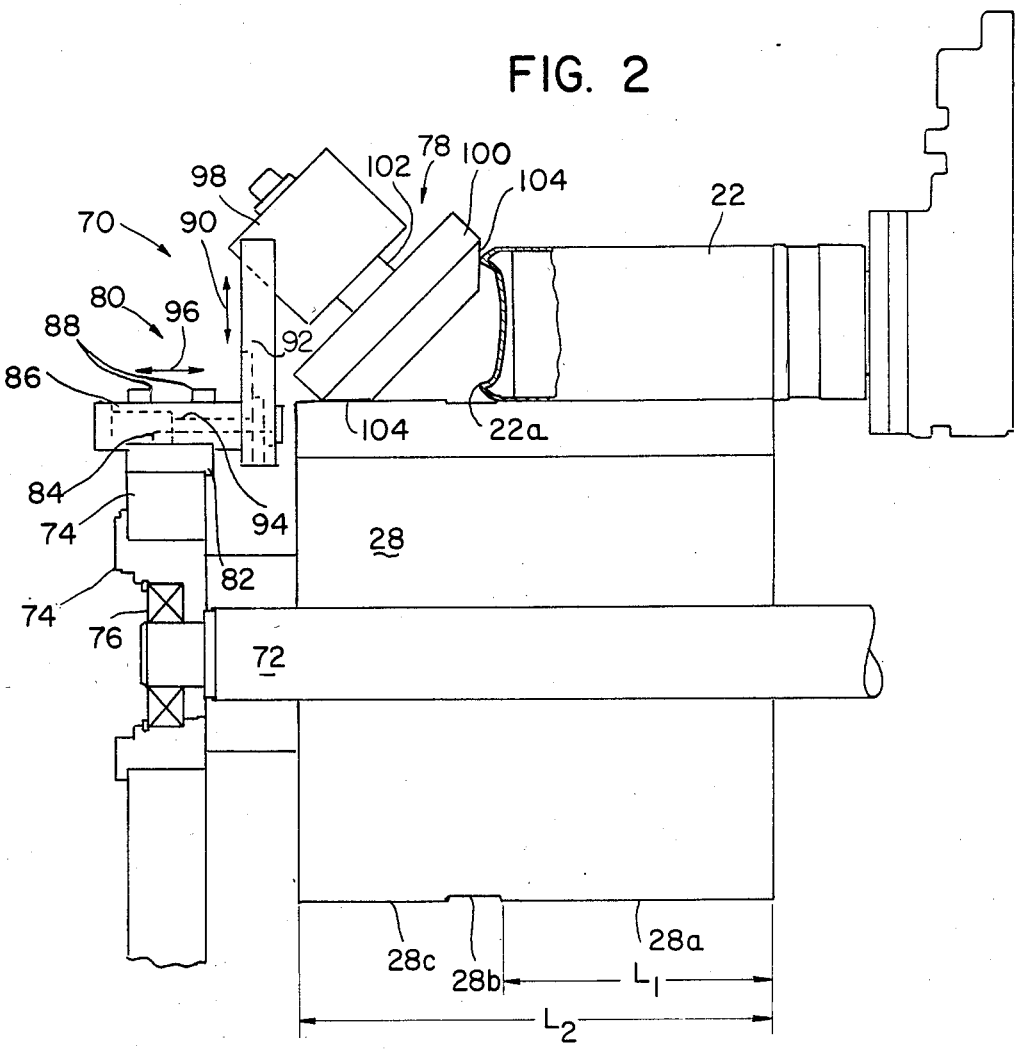
FIG. 2 is an enlarged partly sectioned side elevational view of the bottom rim coater of the intermittently operated container decorating apparatus according to the present invention.
Figure 3:
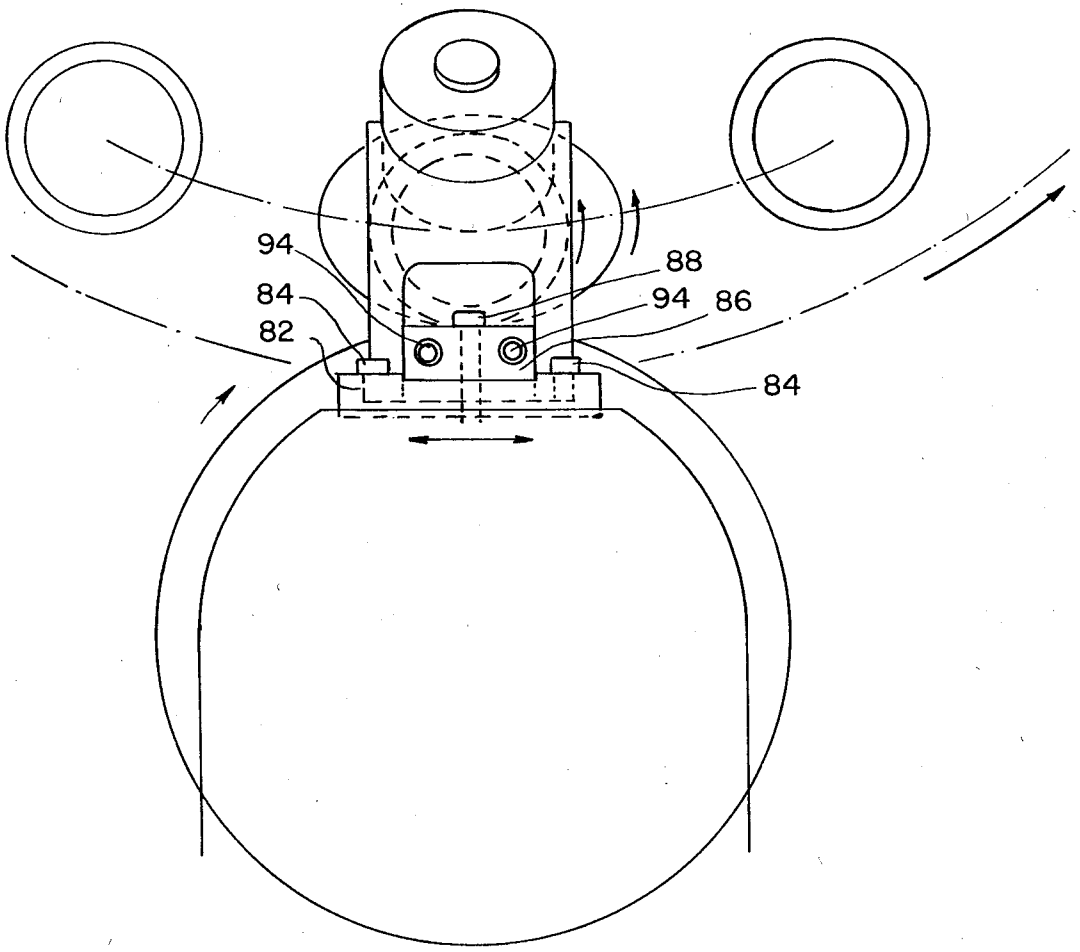
FIG. 3 is a front elevational view of the bottom rim coater of FIG. 2.

Referring now to FIGS. 2 and 3, a bottom rim coater 70 according to the present invention is shown which can be used with the apparatus of FIG. 1A. As shown in FIG. 2, each container 22 is provided with a bottom rim **22*a* to be coated by bottom rim coater 70** with a varnish to protect it from aluminum oxide deposited thereon during subsequent travel through the machine.

As shown in FIG. 2, surface applicator roll 28 is mounted on a rotatable shaft 72 such that a portion **28*a* of the external surface contacts the external cylindrical surface of container or can 22 to apply a varnish thereto. Shaft 72 is rotatably mounted in a supporting structure 74 by means of bearings 76, as is conventional. Conventionally, the external surface of applicator roll 28 only extends for the length $L_1$ of the container 22. In accordance with the present invention, applicator roll 28 is extended to a length past the bottom edge of container 22, as at 28*b* and 28*c*, such that applicator roll 28 has a length $L_2$. The external surface of surface applicator roll 28 is also formed with a circumferential cut-out section 28*b* which forms a circumferential groove contiguous with portions 28*a* and 28*c* and positioned adjacent the bottom edge of container 22 to prevent varnish from beading on the bottom of container 22. Cut-out section 28*b* extends only part way past the bottom of container 22, and the remainder of surface applicator roll 28 extending past the bottom of container 22, indicated by 28*c*, has a radius equivalent to the radius of the portion 28*a* of applicator roll 28 in contact with container 22**.

Bottom can coater 70 according to the present invention includes a bottom rim roller assembly 78 and a support assembly 80 therefor. More particularly, support assembly 80 includes a base 82 fixedly secured to supporting structure 74 by means of bolts 84. A can pressure adjustment support 86 is positioned on top of base 82 and secured thereto by means of bolts 88 which fit within longitudinal slots (not shown) of can pressure adjustment support 86. By loosening of bolts 88, can pressure adjustment support 86 can be displaced in the horizontal direction of FIG. 2 along the slots, as indicated by arrow 96, whereupon bolts 88 are tightened to maintain support 86 in the desired position. In like manner, a roller pressure adjustment support 92 is secured to the end of can pressure adjustment support 86 by means of bolts 94 positioned within longitudinal slots (not shown) of roller pressure adjustment support 92, whereby loosening of bolts 94 allows displacement of roller pressure adjustment support 92 in the vertical direction of FIG. 2, indicated by arrow 90. Bolts 94 are then tightened to maintain support 92 in the desired position.

As shown in FIG. 2, the upper end of roller pressure adjustment support 92 extends to a position above container 22. Bottom rim roller assembly 78 is attached to the upper end of roller pressure adjustment support 92 by welding or the like. More particularly, bottom rim roller assembly 78 includes a roller support 98 welded to the upper end of roller pressure adjustment support 92 so as to extend at an angle of approximately 45° to the axis of rotation of container 22 and surface applicator roll 28. Bottom rim roller assembly 78 further includes a bottom rim roller 100 mounted on a rotatable shaft 102 which is rotatably secured to roller support 98 by any suitable means, such as bearings or the like, with the axis of rotation of roller 100 and shaft 102 also being at approximately 45° from the axis of rotation of container 22 and surface applicator roll 28. Bottom rim roller 100 is formed with a circumferential beveled or tapered edge 104 at its distal end which tapers inwardly at an approximate 45° angle, the tapered circumferential surface thereof being used to coat the bottom rim 22*a* of container 22 with varnish.

During initial adjustment, roller pressure adjustment support 92 is adjusted in the vertical direction of FIG. 3, indicated by arrow 90, so that tapered surface 104 of bottom rim roller 100 is in contact with the portion 28*c* of the external surface of surface applicator roll 28 that extends past the bottom of container 22. The pressure of tapered surface 104 on surface 28*c* of surface applicator roll 28 determines the amount of varnish that is transferred to roller 100. In like manner, adjustment of bottom rim roller 100 toward or away from container 22, as indicated by arrow 96 in FIG. 3, varies the pressure of tapered surface 104 on the bottom rim 22*a* of container 22.

In operation, surface applicator roller 28 which is rotatably driven by suitable means (not shown), in turn, drives bottom rim roller 100, which is freely rotatable, and applies varnish to tapered surface 104 thereof. The varnish applied to tapered surface 104 is transferred during rotation thereof to bottom rim 22*a* of container 22 to apply a coat of varnish thereto. With the arrangement of bottom rim coater 70 according to the present invention, varnish is easily and readily applied to the bottom rim 22*a* of each container at the same time that varnish is applied to the cylindrical surface thereof by surface applicator roll 28. As a result, the varnish applied to the bottom rim of each can is also dried by ultraviolet light during subsequent intermittent travel of the container. There is therefore no need to employ an additional curing oven for the varnish applied to the bottom rim of each container and, in fact, there is no need to use any curing oven with bottom rim coater 70 according to the present invention when used in an intermittently operated container decorating apparatus.

Having described a specific preferred enbodiment of the invention with reference to the accompanying drawings, it is to be understood that the present invention is not limited to that precise embodiment, and that various changes and modifications may be effected therein by one of ordinary skill in the art without departing from the scope and spirit of the present invention as defined by the appended claims.

What is claimed is:

1. Intermittently operated apparatus for decorating cylindrical containers, each container having a cylindrical surface and a rim, said apparatus comprising:

rotatable mandrel wheel means;

a plurality of mandrel assembly means mounted on said mandrel wheel means for holding said containers on said mandrel wheel means;

surface applicator roll means for applying a coating of material to the cylindrical surface of each container;

supply means for supplying said material to said surface applicator roll means; and rim applicator roller means in coating transfer communication with said surface applicator roll means for applying a coating of said material on the rim of each container.

2. Intermittently operated apparatus for decorating cylindrical containers, each container having a cylindrical surface and a rim, said apparatus comprising:

rotatable mandrel wheel means;

a plurality of mandrel assembly means mounted on said mandrel wheel means for holding said containes on said mandrel wheel means;

surface applicator roll means for applying a coating of material to the cylindrical surface of each container;

supply means for supplying said material to said surface applicator roll means; and rim applicator roller means cooperating with said surface applicator roll means for applying a coating of said material on the rim of each container, said rim applicator roller means including a freely rotatable rim applicator roller having a tapered circumferential surface positioned in contact with said surface applicator roll means and the rim of each respective container, wherein the latter container has a coating of material applied to the cylindrical surface thereof by said surface applicator roll means.

3. Apparatus according to claim 2; in which said rim applicator roller means is rotatably contacted and driven by said surface applicator roll means and has said material applied to the tapered surface thereof by said surface applicator roll means during contact therewith.

4. Apparatus according to claim 2; further comprising adjusting means for adjusting the position of said rim applicator roller means with respect to said surface applicator roll means and each said container.

5. Apparatus according to claim 4; in which said adjusting means includes can pressure adjustment means for adjusting the pressure of said rim applicator roller means on the rim of each respective container.

6. Apparatus according to claim 4; in which said adjusting means includes roller pressure adjustment means for adjusting the pressure of said rim applicator roller means on said surface applicator roll means.

7. Apparatus according to claim 6; further comprising support structure means; and in which said roller pressure adjustment means is mounted on said support structure means and is adjustable in a first direction relative to said support structure means.

8. Apparatus according to claim 7; in which said adjusting means includes can pressure adjustment means for adjusting the pressure of said rim applicator roller means on the rim of the respective container.

9. Apparatus according to claim 8; in which said can pressure adjustment means is mounted on said roller pressure adjustment means and is adjustable relative thereto in a second direction substantially perpendicular to said first direction.

10. Apparatus according to claim 9; in which said rim applicator roller means is secured to said can pressure adjustment means and freely rotatable with respect thereto.

11. Apparatus according to claim 2; in which said surface applicator roll means has a length greater than the length of each said container and extends past the rim of each said container; and the tapered surface of said bottom rim roller means is positioned in contact with the portion of the surface of said surface applicator roll means that extends past the rim of each said container.

12. Apparatus according to claim 11; in which said surface applicator roll means includes a circumferential cut-out section which forms a circumferential groove positioned adjacent the rim of each said container.

* * * * *